United States Patent [19]

Johnson

[11] 4,126,912

[45] Nov. 28, 1978

[54] CLOSING ATTACHMENT KIT FOR SLIDING DOOR AND ANTI-FRICTION SUPPORT

[76] Inventor: W. Grant Johnson, 1642 Mockingbird Pl., Orange, Calif. 92667

[21] Appl. No.: 808,793

[22] Filed: Jun. 22, 1977

Related U.S. Application Data

[63] Continuation-in-part of Ser. No. 655,639, Feb. 6, 1976, abandoned, and Ser. No. 764,450, Jan. 31, 1977, abandoned.

[51] Int. Cl.[2] ..... E05F 1/02; E05D 13/02

[52] U.S. Cl. ..... 16/81; 16/99; 16/105; 49/425; 292/251.5; 292/DIG. 46

[58] Field of Search ..... 16/81, 97, 99, 100, 16/101, 105; 49/387, 404, 420, 421, 425, 427

[56] References Cited

U.S. PATENT DOCUMENTS

| | | | |
|---|---|---|---|
| 483,169 | 9/1892 | Schneewind | 16/81 |
| 2,659,939 | 11/1953 | Greig | 49/425 |
| 2,762,675 | 9/1956 | Janows | 312/319 |
| 2,834,069 | 5/1958 | Perrone | 49/425 |
| 2,867,859 | 1/1959 | Brink et al. | 49/420 |
| 2,992,450 | 7/1961 | Pittenger | 16/78 |
| 3,111,209 | 11/1963 | Riegelman | 49/425 |
| 3,208,109 | 9/1965 | Buck, Jr. | 49/425 |
| 3,237,238 | 3/1966 | Anderson | 49/425 X |
| 3,258,875 | 7/1966 | Ulman | 49/379 |
| 3,298,136 | 11/1967 | Saunders | 49/425 |
| 3,328,105 | 6/1967 | Trulaske | 16/81 X |
| 3,341,973 | 9/1967 | Miller | 49/420 |
| 3,760,535 | 9/1973 | Trulaske | 49/404 X |
| 4,004,372 | 1/1977 | Beard et al. | 49/404 |

*Primary Examiner*—Price C. Faw, Jr.
*Assistant Examiner*—Conrad L. Berman
*Attorney, Agent, or Firm*—Gausewitz, Carr & Rothenberg

[57] ABSTRACT

A unitary self-contained kit of components is readily attachable to a sliding door without modification of the door to effect gravity actuated closing. The kit includes a guide channel and pulley that are simply adhesively secured to an outwardly facing surface portion of the door at the rear of the door. A weight is slidably confined within the guide and hangs from a line entrained over the pulley and connected to a hook on the doorway lintel. Included in the kit is a universal wheel and bracket assembly that can be readily mounted on many different types of doors.

33 Claims, 13 Drawing Figures

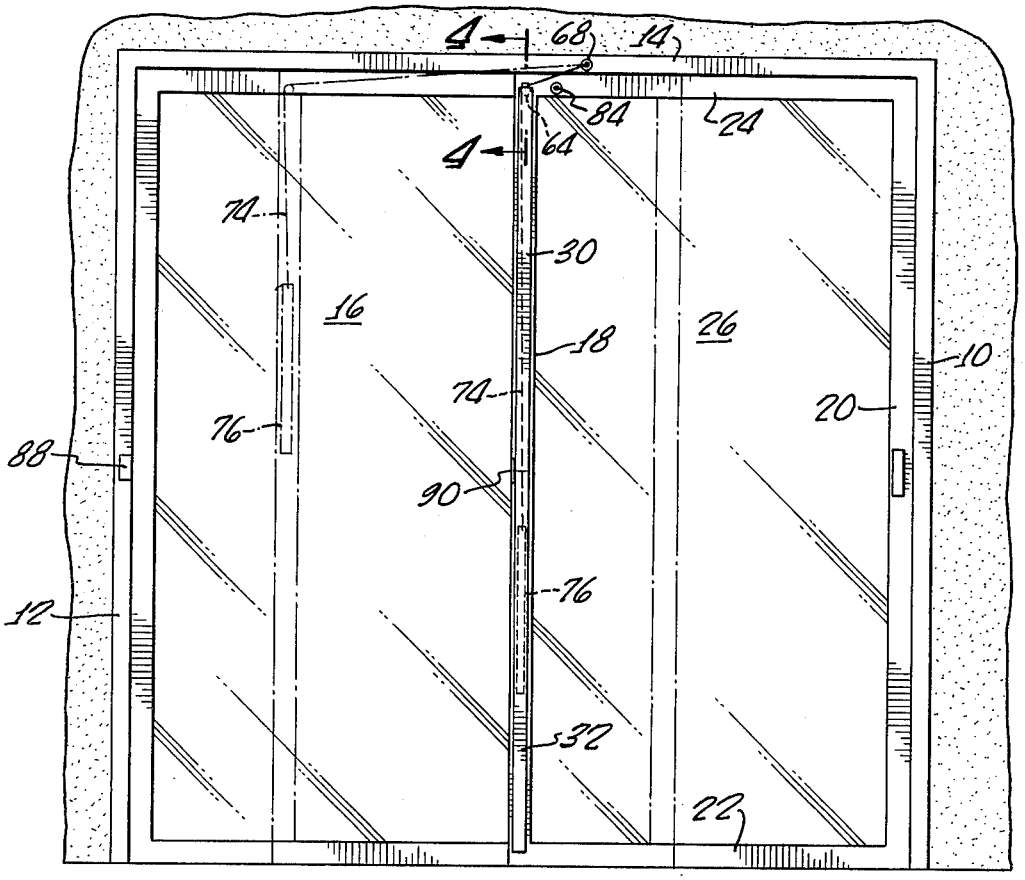
FIG. 1.
FIG. 5.
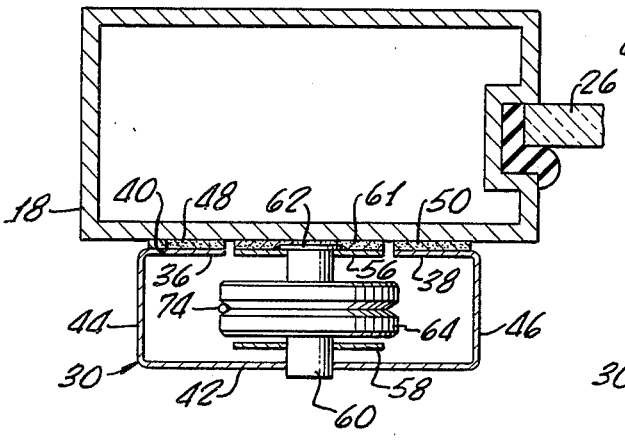
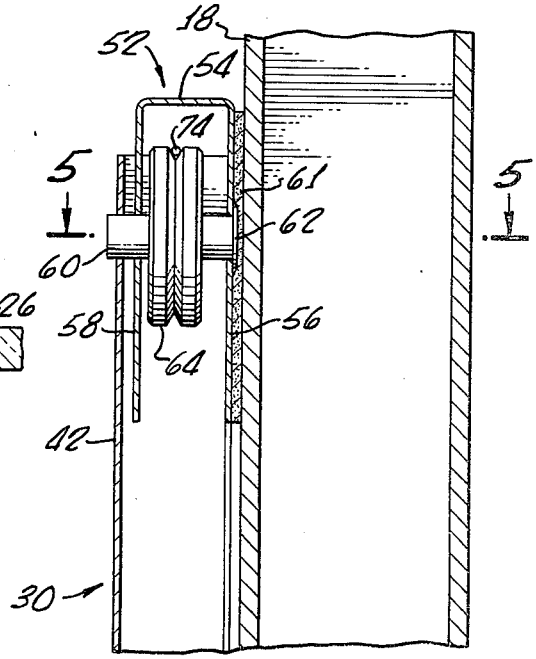
FIG. 4.

14
68
70
72
74
84
52
54
58
56
36
64
60
42
30
40
90
18
32
88
44
74
12
80
76
78
32

44
42
54
34
52
64
62
46
36
38
61
58
56
30
18

CLOSING ATTACHMENT KIT FOR SLIDING DOOR AND ANTI-FRICTION SUPPORT

CROSS REFERENCE TO RELATED APPLICATIONS:

This application is a continuation-in-part of both applications Ser. No. 655,639, filed Feb. 6, ¼, now abandoned, for AUTOMATIC CLOSING ATTACHMENT KIT FOR SLIDING DOOR, and Ser. No. 764,450, filed Jan. 31, 1977, now abandoned, for ANTI-FRICTION SUPPORT FOR SLIDING CLOSURES. The disclosures of both of such applications are incorporated by this reference as though fully set forth herein.

BACKGROUND OF THE INVENTION

This invention relates to sliding door closing mechanisms and more particularly concerns a self-contained unitary package of components that may be readily attached to an existing door to effect closing thereof.

Many different types of door closing mechanisms have been developed and employed to meet a variety of requirements for self-actuated door closing operation. Such mechanisms include pneumatic devices, springs and counter-balancing apparatus. Many counter-balancing door closing mechanisms embody a weight suspended from a cord entrained over a pulley that is carried on the fixed door frame or in a wall of the cabinet in which the sliding door is mounted. In such arrangements, the line from which the weight is suspended must extend across the open doorway when the door is in its open position. Such a line is unsightly, and may interfere with use of the doorway unless rather complex and costly steps are taken to run the line internally of the door or door frame. Mechanisms of this type, whether mounted on the fixed door frame or carried on the door itself, have been mounted internally of the door frame or door. Thus, counter-balancing weight guideways have been mounted within the door frame or a cabinet wall during manufacture. However, no structures or apparatus have been available that may be applied to an existing door once it has been built or installed, to achieve a self-closing operation.

The common and widely employed sliding glass door and sliding screen door are formed of extruded aluminum frame elements which are secured to the glass or screen that complete the door. The extrusions of which these doors are made and the door frames in which such doors are installed do not readily lend themselves to application of counter-balanced closure mechanisms known in the prior art. Thus, there presently exists a vast number of such sliding doors, now installed and in operation, which would greatly benefit from a self-actuated closing mechanism but for which no such mechanism is presently available within practical economic limits.

For use of door closers of reasonably limited size and weight it is necessry to minimize the sliding friction of the door and thus a door closer kit should include low friction glides or wheels. However, if the door closer kit is arranged to be mounted upon many different types of doors, the anti-friction wheel must also be universally applicable.

Sliding door wheels and their carrying brackets are usually designed for a particular configuration of door. They require screws, bolts, or the like, both to fix the wheel and bracket to the door and to provide for vertical adjustment of the door relative to its supporting track. Such wheels and bracket assemblies of the prior art are relatively complex and costly, both to manufacture and to install.

In slidable closure members, the anti-friction elements, wheels or slides, will generally wear or become inoperable while the closure member itself is still in good condition. Thus, it is often necessary to replace such anti-friction devices. At present, many different types of sliding closures are employed and few, if any, of the anti-friction devices, such as wheel and bracket assemblies, are capable of use with more than one of such closure members. Thus, suppliers must stock many different kinds of sliding door wheels and even so, a replacement wheel that will fit a particular type of sliding closure member is often not available, or at best, difficult to locate.

Such replacement wheels in any event must be mounted and/or adjusted by means of screws, bolts, or the like, extending through the door frame, requiring tools and some skill to effect replacement or even adjustment.

Accordingly, it is an object of the present invention to provide a sliding door closing mechanism and an anti-friction assembly that are effective, economical and avoid or minimize problems of the prior art.

SUMMARY OF THE INVENTION

In carrying out principles of the present invention in accordance with a preferred embodiment thereof, a self-contained unitary package of components is adapted to be mounted upon an existing sliding door assembly without tools and without disturbing the existing installation. The mechanism includes a vertically extending elongated guide having a contact portion that conforms to an outwardly facing surface portion of the door. Means are provided for securing the guide to the door with the contact portion of the door guide contiguous to the outwardly facing surface portion of the door. A pulley is rotatably mounted to and within the guide. A hook secured to the doorway lintel secures a line that is entrained over the pulley and connected to a weight that is slidable in the guide. According to another feature of the invention, the components of this package are configured so that they may be readily mounted to the existing surface of the door and doorway frame without structural modification of the door or door frame and yet are readily transported and packaged.

An anti-friction assembly comprises a bracket having mutually spaced sides extending in side-by-side relation and connected to each other. Bottom portions of the sides carry laterally outwardly projecting flanges for support of spaced sidewalls of the lower frame member of the sliding closure, and an anti-friction member is positioned between the sides. According to a feature of the invention, the bracket is resilient, of generally U-shaped cross-sectional configuration, and is flared outwardly to enable it to be frictionally retained within different frame members of different types of closures. According to another feature of the invention, an anti-friction device is carried by the bracket for adjustment relative thereto. The improved anti-friction device can be used alone, without the door closer kit, but can also be included in the kit to greatly enhance its effectivity.

BRIEF DESCRIPTION OF THE DRAWINGS

FIG. 1 illustrates a doorway frame and sliding door having the closing mechanism of the present invention installed thereon and showing an open position of the door in dotted lines;

FIG. 4 is a section taken on lines 4—4 of FIG. 1;

FIG. 5 is a section taken on lines 5—5 of FIG. 4;

DESCRIPTION OF THE PREFERRED EMBODIMENT

Figures 2, 3:
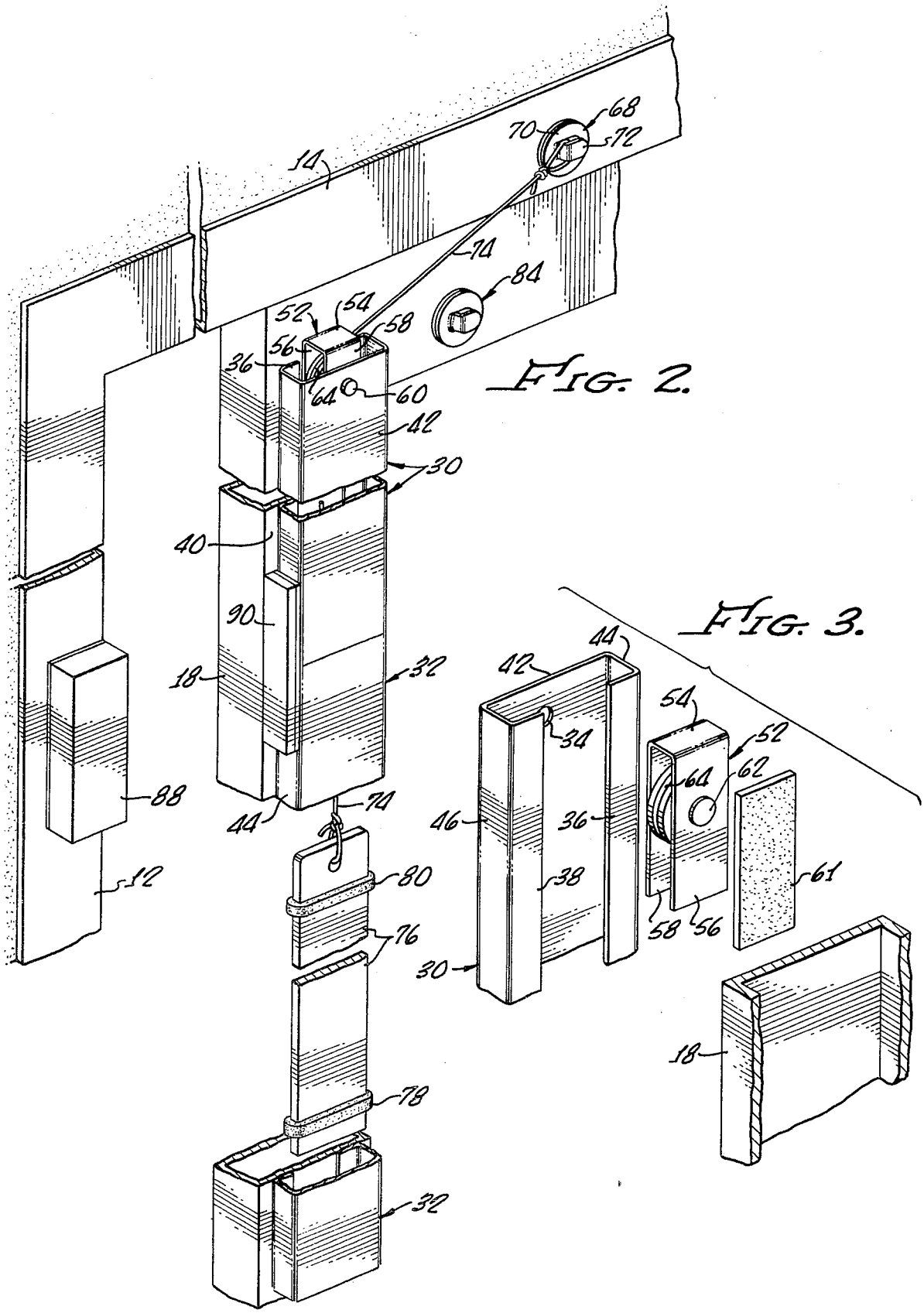
FIG. 2 is an enlarged perspective view of parts of the mechanism of FIG. 1.
FIG. 3 is an exploded perspective view of several of the components in relation to the door.

Principles of the present invention as applicable to many different types of sliding doors whether single doors or plural sliding doors and also are useful in a number of different applications. However, for purposes of exposition the invention is illustrated as shown in FIG. 1 in connection with a conventional sliding glass door in which the doorway includes a frame having jambs 10 and 12 and an overhead lintel 14. A fixed panel such as a glass sheet 16 closes part, approximately half in an exemplary arrangement, of the doorway defined by the jambs and lintel. A conventional sliding door closes the remainder of the doorway opening and includes a frame having a pair of stiles 18 and 20 that interconnect horizontal door frame members 22, 24 and collectively mount a glass panel 26. The door is slidably mounted by universal anti-friction means for motion in the plane of the doorway from the closed position illustrated in solid lines in FIG. 1 to a partly open position illustrated in dotted lines and to a fully open position (not shown).

According to principles of the present invention, a unitary self-contained package of components may be applied to the door and to the door frame without structurally modifying any elements of the door or door frame and yet achieves effective and satisfactory self-closing operation of the door. The components of this self-closing kit include a vertically extending elongated guide formed of first and second guide sections 30, 32 which are substantially identical to each other except for an aperture 34 (FIG. 3) formed in the upper portion of guide section 30. The guide sections are of generally tubular configuration and may have any one of a number of desired cross-sectional configurations adapted to slidably confine and guide a counter-balancing weight of a selected shape. Nevertheless, for purposes of the present invention and to facilitate attachment of the guide to the flat outwardly facing surface of a more common door stile the guide sections each are formed with contact portions 36, 38 (FIGS. 3, 5) that conform to the configuration of the outwardly facing surface 40 of the door stile. Preferably each guide section has a C-shaped cross-section with a channel web 42, a pair of opposed channel ends 44, 46 and a pair of mutually facing and mutually spaced coplanar flanges that provide the guide contact portions 36, 38. The guide sections 30, 32 may be made either as a single integral channel member extending the full length of the door stile or may be made in two or more longitudinally butting sections for ease of packaging and transporting. At present, to facilitate packaging, it is preferred to make the guide in the two sections illustrated. Aluminum or plastic are preferred guide materials.

The guide sections are firmly secured to the outwardly facing surface of the rear stile of the door by means of adhesive strips having an adhesive on both mutually opposed sides thereof. Such two sided adhesive strips need not extend the full length of the guide but may extend for one or two inches at the upper and lower ends of each of the flanges 36, 38 of each of the guide sections 30, 32. Two of these strips are illustrated at 48, 50 in FIG. 5.

A U-shaped pulley bracket 52 includes a bight 54 connecting depending legs or plates 56, 58 which are apertured to receive the shaft 60 of a journal pin having an enlarged head 62. A grooved pulley 64 is journalled on the pin 60. The pin is loose in its aperture in the pulley and the bracket plates 56, 58 and thus the several parts may be readily assembled into the relation illustrated in FIG. 3. A strip 61 of double sided adhesive is secured to the outer surface of the bracket plate 56 extending over the head 62 of the pin 60 and has its other side secured to the outwardly facing surface of the rear stile 18 of the door to thereby secure the bracket and pulley to the door and to capture the pivot pin which is thus firmly retained in position. The outer end of the pin 60 extends through the aperture 34 in the web 42 of the upper guide section 30 (FIG. 4). Thus the pulley is supported in part by the guide and in part by the door itself. When assembled, as shown in FIGS. 2, 4 and 5, the bracket plate 56 is a close fit between the coplanar guide flanges 36, 38 and itself is substantially coplanar therewith.

A hook 68, conveniently formed of a metal disc 70 and a tongue 72 which is struck from a center portion of the disc, is secured to the door frame lintel 14 at a point adjacent the rear stile 18 when the door is in closed position. An inextensible line 74 has one end secured to the hook 68, is entrained over the pulley 64, and extends downwardly through the interior of the guide channels 30, 32 for attachment to the upper end of an elongated weight 76. Weight 76 has resilient bumpers 78, 80 such as rubber rings, for example, elastically expanded over its opposite ends to assist in guiding the weight in its slidable path through the guide and to decrease the noise of contact of the weight with the interior of the guide. A second hook 84 is affixed to the frame member 24 of the door substantially below the hook 68 (with the door in closed position) so that the closing mechanism may be temporarily disabled with desired simply by disconnecting the line from hook 68 and reconnecting it to hook 84. Both hooks are secured in place by strips of double sided adhesive that are included in the self-closing kit.

To hold the door in open position against the closing action of the weight 76, a permanent magnet 88 is fixed to the jamb 12 which is adjacent the rear stile 18 when the door is in open position, and a strip of magnetizable material, such as a ferrous material or steel strip 90 is fixed to the rearwardly facing guide channel end 44.

Preferably the ferrous strip 90 is secured to the guide by a double sided adhesive strip and positioned over the butting ends of guide sections 30, 32 to thereby bridge and strengthen the joint between these elements.

The described components comprising the two guide section, the pulley assembly comprising pulley and journal pin, the two hooks, the line, the weight and the bumpers therefor, the magnet and magnetic strip, together with a length of suitable adhesive strip are all contained in a single package and may all be applied to existing and operating sliding doors without any structural modification of the door or door frame and without the use of any tools.

For a common screen door, it is found that a weight of approximately twelve ounces will achieve effective operation, whereas, for a sliding glass door of standard six foot eight inch by three foot six inch dimensions, a twenty-four ounce weight will suffice. In installation of the closing mechanism, the pulley and its pin are first assembled to the pulley bracket in the relation shown in FIG. 3. The bracket plate 56 is then secured to an upper portion of the rear stile of the door by means of a strip of double sided adhesive. Then, hook 68 is fixed to the door frame lintel at a point just forward of the closed position of the rear stile 18. One end of the line 74 is attached to the hook 68 and entrained over the pulley and underneath bight 54 of the pulley bracket. The weight 76 is then attached to the line so as to hang with its bottom approximately one inch above the bottom of the closed door. Now the first and upper section of the guide, section 30, is adhesively secured to the outwardly facing surface of the rear stile with the journal pin 60 extending through the aperture 34 of the guide web 42 and with the guide flanges 36, 38 straddling the pulley bracket plate 56. The upper edge of the guide section 30 is positioned no higher than and preferably slightly below the bight 54 of the pulley bracket, this relation being established by the position of the hole 34 in the web 42. At this time, the string extends through the upper section 30 of the guide and down through its bottom end with the weight hanging along the rear stile below the guide section 30 but completely exposed. Now, operation of the closing mechanism may be tested and the length of the string or line between the hook and weight may be adjusted as necessary in order to assure that the door may open fully and close fully without obstruction of motion of the weight relative to the guide. Having completed this adjustment, the bottom section 32 of the guide is then aligned with the upper section 30 with the weight and string confined within the section 32 and the latter is adhesively secured to the door stile by strips of double sided adhesive. The magnetizable ferrous strip 90 is then fixed to the door guides at their junction. The door is moved to its fully open position so that the magnet 88 may be located and properly secured by an adhesive strip to the jamb 12. The secondary hook 84 is adhesively attached to the door frame member 24.

In operation, as the door is moved from its closed position, the pulley 64 moves to the left as viewed in FIG. 1 and thus the length of line between the pulley and hook 68 is increased. This lifts the weight which rises within the confining guide channel sections. When the door attains its fully open position, the magnet exerts a holding force upon the ferrous strip 90 which is sufficient to overcome the closing force of weight 76 and the door is held in open position. A slight closing pull upon the door is sufficient to overcome the attraction of the magnet, releasing its latching action, whereupon weight 76 descends within the guide sections 30, 32 thereby exerting a force acting upon the pulley 64 toward the right as seen in FIG. 1, to drive the door to its closed position. To disable this gravity actuated closing action, it is merely necessary to disconnect the line from hook 68 which is on the fixed lintel 14 and reconnect it to the hook 84 which is on the movable door member 24. Thus, the mechanism is ready to be put back in operation merely by reconnecting the end of the line from the hook 64 to the hook 68. If the door is opened to a position short of its fully open position or if magnet 88 is removed, the door will close when it is released.

Figure 6:
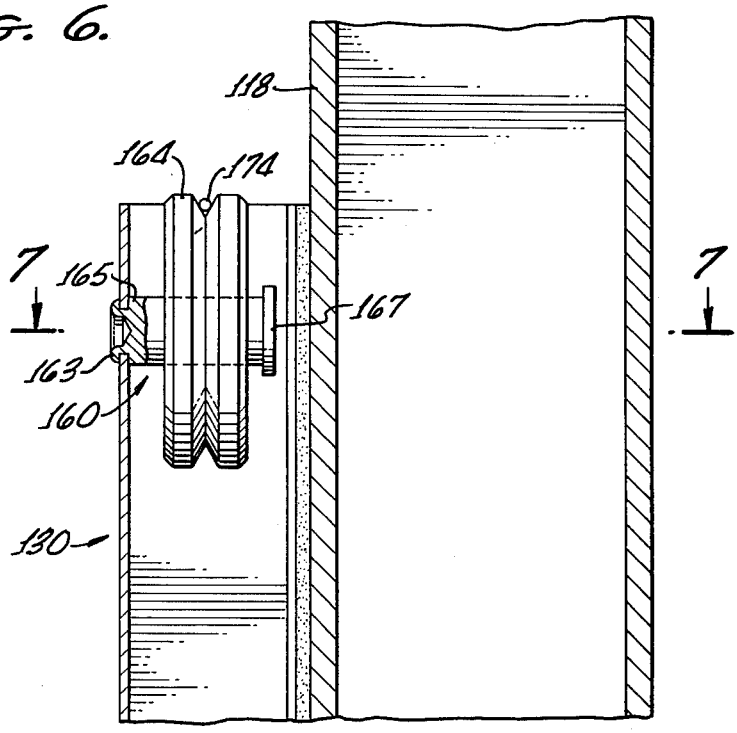
FIGS. 6 and 7 are fragmentary sectional views of a modification of the embodiment of FIGS. 1–5.
Figure 7:
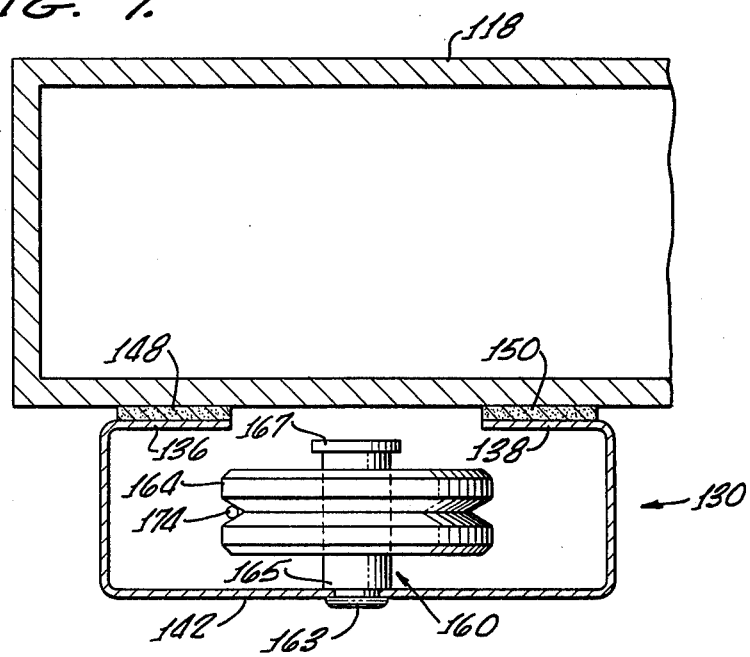

Illustrated in FIGS. 6 and 7 is a modification of the arrangement for securing a pulley to an upper guide section 130 that is secured to a door stile 118 by adhesive strips 148, 150 in the manner previously described in connection with the embodiment of FIGS. 1–5. Except for the modified mounting of the pulley, this embodiment is identical to the embodiment of FIGS. 1–5. In the arrangement of FIGS. 6 and 7, the pulley is permanently mounted to the upper end of guide section 130 and no bracket is employed. Pulley 164 is journaled upon the body of a pin 160 having main body portion 165 which is reduced to provide a head 163 that extends through an aperture in the web 142 of guide section 130. Head 163 is upset to fixedly connect the pin 160 to the guide section web 142 between the deformed head and the enlarged body section 165. The diameter of the pulley is greater than the space between adjacent flanges 136, 138 of the guide section 130 wherefor the pulley is securely retained, being captured within the guide section 130. However, if deemed necessary or desirable, the pin 160 can be formed with its inner end enlarged as at 167 to insure retention of the pulley upon the pin.

In this arrangement the pulley and the pin are assembled to the guide section before the components are packaged so that this operation need not be performed upon installation. No bracket is needed nor employed to support the pulley nor is there needed any adhesive strip to support the pulley. The pulley is journaled upon the pin 160 which is directly supported from and cantilevered upon the guide section 130. The guide section is secured in place as previously described by strips of double sided adhesive, such as indicated in 148, 150.

As previously described, the self-closing mechanism is universal, e.g., adapted for installation on any one of many different types of doors and, further, is small and lightweight for economy, appearance and packaging convenience. For these reasons, among others, optimum operation of the mechanism is achieved when door friction is minimized. To this end, the self-closing kit should include improved antifriction devices. To be of use in a universal self-closing kit, the anti-friction devices themselves must be of universal application. Such universally applicable wheel and bracket assembly is illustrated in FIGS. 8–13 and described below.

The self-closing mechanism and wheel assemblies, both applicable to many different types of doors, and both capable of installation without tools, provide a unitary result in a single package, operating synergistically in that the self-closing mechanism, when used with the universal wheel assemblies, can still be light and small, and applied to many different types of doors. Thus, although the self-closing mechanism is useful with existing and conventional door slides, both its operation and application are significantly and surprisingly enhanced by concomitant use of the universal wheel assemblies described below.

Figure 8:
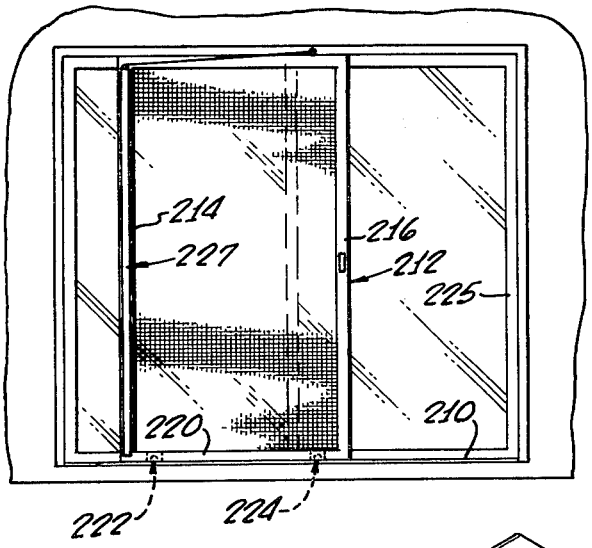
FIG. 8 illustrates a supporting track and a sliding door having a pair of wheels to support the door upon the track, with a door closer attached thereto.

A typical sliding closure assembly of the type previously described is illustrated in FIG. 8 as including a fixed horizontal track 210 upon which is slidably mounted (for motion from right to left and from left to right as viewed in FIG. 8) a sliding door 212 having stiles 214, 216 and a lower frame member 220. The door, by means of its lower frame member 220, rests upon and carries first and second anti-friction assemblies 222, 224 that decrease the friction between the door and its track 210 and in addition, permit vertical adjustment or tilting of the door for alignment with the doorway frame 225. The sliding closure assembly includes a self-closing door mechanism 227 of the type described above.

Although many types of door and window frame constructions are known and employed, one of the most widely employed door configurations incorporates stile and frame members of a shaped metal, such as extruded aluminum, having a generally channel shaped cross-sectional configuration. Such channel or channel shaped frame members are employed for sliding glass doors or panels and also for sliding screen doors.

Figure 9:
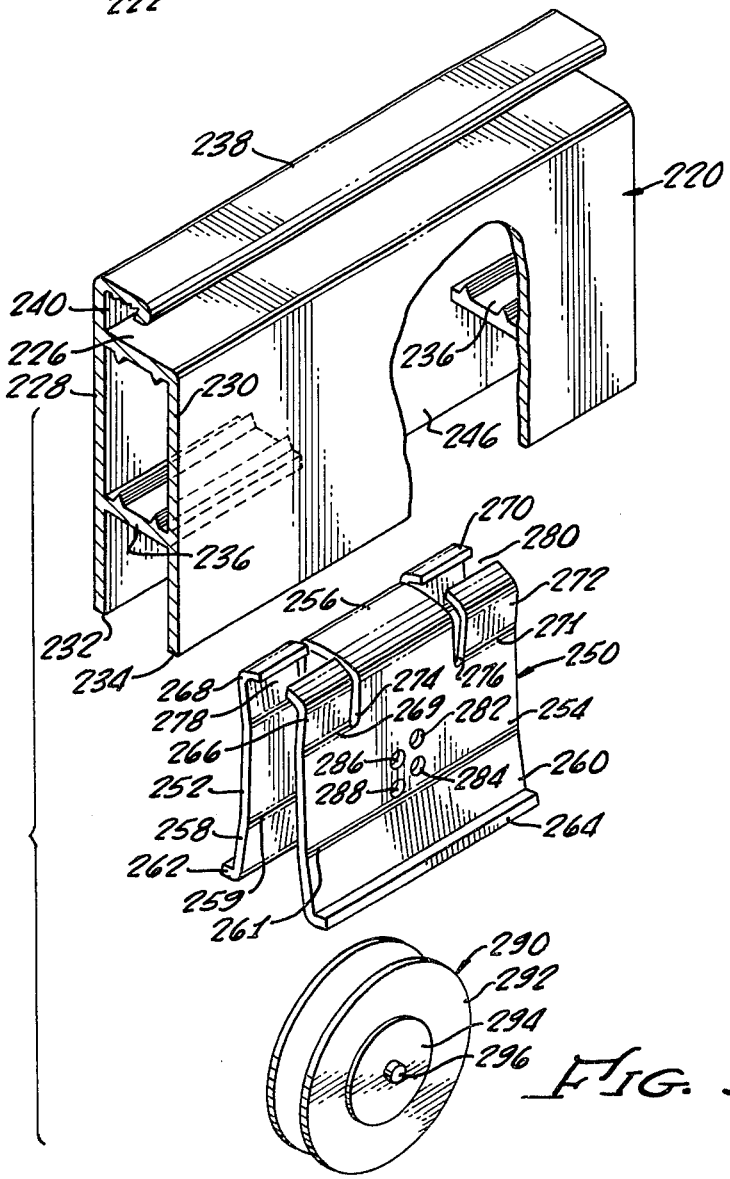
FIG. 9 is an exploded perspective of a portion of the lower door frame channel, and a bracket and wheel embodying principles of this invention.

As illustrated in FIG. 9, a typical configuration of such a door frame channel 220 includes a channel bight or primary web 226 interconnecting first and second mutually spaced channel sidewalls or sidewall elements 228, 230. The channel opens downwardly for the horizontal lower door frame member 220, providing downwardly facing sidewall edges 232, 234. A transverse stiffening web 236 is frequently provided, bridging the sidewalls below the primary web 226. For securing a screen, the generally channel shaped extrusion is formed with an integral somewhat L-shaped extension 238 that forms a recess 240 for reception of an end portion of a screen member 242 (FIG. 10) and a screen retaining gasket 244. Of course, in frame members for glass doors the channel extension is configured for mounting a sheet of glass.

In many door constructions the secondary web 236 is cut away to provide one or more elongated apertures, such as the aperture indicated at 246 in FIG. 9. Such an aperture will receive a wheel that is commonly positioned between the channel sidewalls and screwed or bolted thereto. Commonly two or more screws, bolts, or adjusting pins are provided to fixedly secure each wheel bracket assembly of the prior art in position and to permit limited vertical and tilting adjustment of the bracket relative to the door frame channel. In such prior art arrangements, the wheel is journaled in a fixed position to the bracket itself.

In prior door frame constructions of the general type described above, frame channel dimensions will vary from one type of door to another, within certain limited ranges. Therefore, different arrangements and configurations of apertures (not shown) are provided in the channel sidewalls for reception of screws, bolts or pins for mounting and adjusting the wheel bracket assembly. Despite such differences, which heretofore have required different configurations of bracket and wheel assemblies, a number of such door frame channels have several common features. These include mutually spaced channels sidewalls having downwardly facing edges and sufficient clearance, as by an aperture formed in the secondary web 236, for reception of a wheel.

According to principles of the present invention, such features that are common to many different types of door configurations are employed for reception and mounting of an improved wheel and bracket assembly, despite a significant range of variation in channel dimensions, and regardless of position, size and number of wheel and bracket mounting apertures formed in the channel sidewalls.

As best seen in FIG. 9, a presently preferred embodiment of the present invention includes a generally U-shaped bracket 250 having first and second mutually spaced sides 252, 254 extending in side-by-side relation and interconnected at the top portion thereof by means of a bight 256.

In the unstressed condition shown in FIG. 9, the bracket sides diverge outwardly and downwardly from the bight. In addition, lower portions 258, 260 of the bracket sides are bent outwardly along lines 259, 261, relative to diverging upper portions, and terminate in laterally projecting door supporting flanges 262, 264 respectively.

The diverging sides and the outwardly bent sections 258, 260 provide an outward flare of the bracket at its bottom portion. A corresponding outward flaring of the bracket is provided at its top portion by means of a number of outwardly projecting resilient fingers 266, 268, 270 and 272. These resilient fingers may be formed in any manner, but it is found convenient to define these fingers by means of first and second transverse slots 274, 276 extending through the bight and partly down into the bracket sides and positioned adjacent to but spaced from the bracket ends. First and second longitudinally extending slots 278, 280 cut through those sections of the bight between the transverse slots and the bracket ends and thus complete the definition of the four resilient fingers in this embodiment. The fingers are bent outwardly relative to the bracket sides, along lines such as 269, 271.

A wheel 290 includes a rim section 292 journaled (preferably by suitable ball bearings or the like) on a hub 294 that carries an axle 296 fixed to the hub. Opposite ends of the axle that project from opposite sides of the wheel hub are received in apertures of a selected pair of apertures of the bracket sides and thus the wheel is journaled to and between the bracket sides. The bracket side holes are positioned with respect to the bracket and wheel dimensions to permit a desired range of vertical wheel positions relative to the bottom of the bracket and, therefore, relative to the bottom of the door supported thereon.

Preferably, the bracket is an integral resilient member formed of a suitable stiff and resilient sheet metal, such as steel, although other stiff and resilient materials, including suitable plastics, may be employed. Thus the bracket may be stamped, bent and cut from a strip of sheet steel or may be injection molded of a suitable resilient plastic. Similarly, the wheel may be made of various types of materials, such as steel, plastic or the like.

In forming the resilient fingers 266, 268, 270 and 272, each is bent laterally outwardly of the bracket sides to provide the bracket with an outwardly flaring upper portion. Thus, as best seen in the sectional view of FIG. 10, the bracket flares outwardly both at its upper and lower portions.

The described manner of forming the resilient fingers by slots extending through the bight provides several additional functions and advantages. Because the slots decrease the length of the bight, the bracket will bend only at the bight when the lower portions of the bracket sides are pressed together during insertion into the door frame channel member (as will be described below.) The bracket sides, being of greater length than the transversely cut bight, will bend considerably less, or not at all, thus retaining their shape, although changing their angle of divergence. Further, as the bracket sides are pressed inwardly, the upper portions of the fingers 266, 268, 270, 272 tilt further outwardly by a small amount, so that insertion of the bracket into the channel increases the outward pressure of the fingers.

In assembly of the bracket to the door, the wheel axle 296 has its opposite ends inserted in holes of a pair of aligned holes of the bracket sides. This is easily achieved by slightly spreading the sidewalls from their unstressed diverging position and then allowing the sidewalls to snap back to the normal unstressed position as the axle ends enter the respective bracket side holes. In some configurations, the bracket sides may be slightly pressed together to ensure retention of the wheel axle before insertion of the bracket into the door frame channel. In either case, with the bracket in its operative position and the bracket sides 252, 254 pressed inwardly by virtue of the abutment of sections 258, 260 with the channel sidewalls, the bracket sides are held close enough to each other to prevent the wheel axle from being displaced from its journal apertures.

To insert the subassembly of wheel and bracket into the door, one merely grasps the lower ends of the bracket adjacent the laterally outwardly projecting flanges 262, 264 and presses the bracket into the channel between sidewalls 228, 230. As the bracket begins to enter the channel, the outwardly flaring resilient fingers 266, 268, 270, 272 contact the channel edges 232, 234 and, because of their rounded configuration, are cammed inwardly from their normal, unstressed, outwardly projecting position. The bracket continues to be forced (by means of hand pressure) further into the channel, projecting through the apertures 246 of the secondary web 236, until the channel edges 232, 234 engage the outwardly flaring lower side sections 258, 260. As the bracket is inserted into the channel, the channel lower edges 232, 234 cam the diverging bracket sides inwardly toward each other until the lower edges of the channel 232, 234 abut the laterally outwardly projecting flanges 262, 264, at which point no further inward motion of the bracket relative to the channel can take place. The channel edges 232, 234 are now seated upon the bracket flanges and the channel, together with the rest of the door, is thereby resting upon and carried by the bracket which, in turn, is resting upon and carried by the wheel 290. The bracket sides, between the lower sections 258, 260 and the resilient fingers, are now diverging less than in unstressed condition and are more nearly parallel to each other and to the channel sidewalls from which they are inwardly spaced by the contact of the bent sections 258, 260 with the channel walls. The bracket sides are resiliently urged outwardly away from each other and against the channel sidewalls. Assisted by the spring fingers, the bracket sides thus retain the bracket within the channel.

In normal unstressed position of the bracket, lower portions of the outwardly diverging side sections 258, 260 and outer surfaces of fingers 266, 268, 270, 272 on opposite sides are spaced apart by a distance greater than the distance between the mutually parallel facing interior surfaces of the channel sidewalls 228, 230.

The distance between outer surfaces of the bracket sides at the top of the bracket, is made less than the distance between interior facing surfaces of sidewalls of the smallest channel with which the bracket assembly is to be used. Thus the assembly can be used with channels of small dimensions. The upper and lower flared portions of the bracket, namely the spring fingers and the outwardly diverging side sections, provide the bracket with a significantly greater lateral dimension (in unstressed condition). This dimension is decreased as the resilient bracket is inserted into the door frame channel. Thus the bracket assembly can readily be used with door frame channels of different dimensions.

No screws, bolts, pins or other fastening devices are needed for attachment of the assembly to the door frame channel. The weight of the channel and of the door is resisted almost entirely by the laterally outwardly projecting flanges 262, 264 upon the upper surfaces of which rest the downwardly facing lower edges 232, 234 of the channel sidewalls. A slight amount of additional vertical support is provided by the frictional inter-engagement of the spring fingers and the inner surfaces of the channel sidewalls. However, this frictional engagement provides all of the force required to resist horizontal sliding motion of the bracket longitudinally of the channel. Further, abutment of front and back edges of the bracket with the front and back sides of the aperture 246 (that is formed in the secondary web 236), provides additional assurance of maintaining the longitudinal position of the bracket within the channel.

Figure 10:
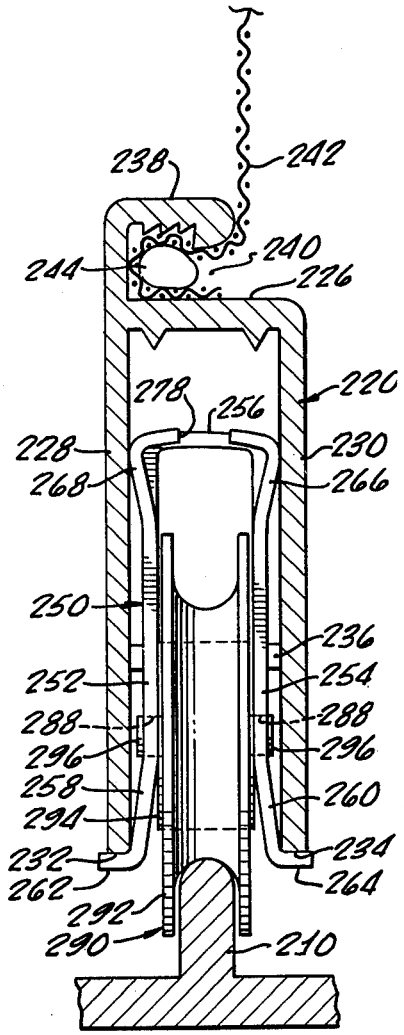
FIG. 10 is a cross-section of the bracket and wheel mounted within the lower door frame channel.

For vertical adjustment of the door, the bracket and wheel assembly is removed from the channel by grasping the edges of flanges 262, 264 and withdrawing the bracket from the channel. The bracket sides are spread apart and the wheel axle is placed into a different pair of apertures for vertical adjustment. The bracket and wheel assembly is them simply reinserted into the channel, thereby again pressing the bracket sides toward each other until the operative position thereof, as illustrated in FIG. 10, is attained.

Although the configuration illustrated is preferred, wherein the bracket flares outwardly at both upper and lower portions, it will be readily appreciated that other resilient frictional holding means and other resilient finger connection can readily be devised. Thus, if deemed necessary or desirable, in addition to or instead of the spring fingers 266, 268, 270, 272, one may secure forwardly and rearwardly projecting fingers to the bracket sides or form such forwardly and rearwardly projecting fingers integral with the bracket. Such fingers would be bent outwardly and all would be resiliently displaceable inwardly to provide frictional retention of the bracket within the channel. In the described bracket configuration, the bracket sides are resiliently interconnected and flare outwardly at various portions thereof to securely retain the bracket within the door frame channel and to detachably mount the wheel. Many variations of this configuration will readily suggest themselves to those skilled in the art. Thus the U-shaped bracket may be formed with its bight on a lateral end portion rather than the top (the latter being illustrated in FIGS. 8–10). With the bight connecting lateral end portions, upper portions of the sides, which are not connected by the bight, may have the fingers formed thereon.

Figure 11:
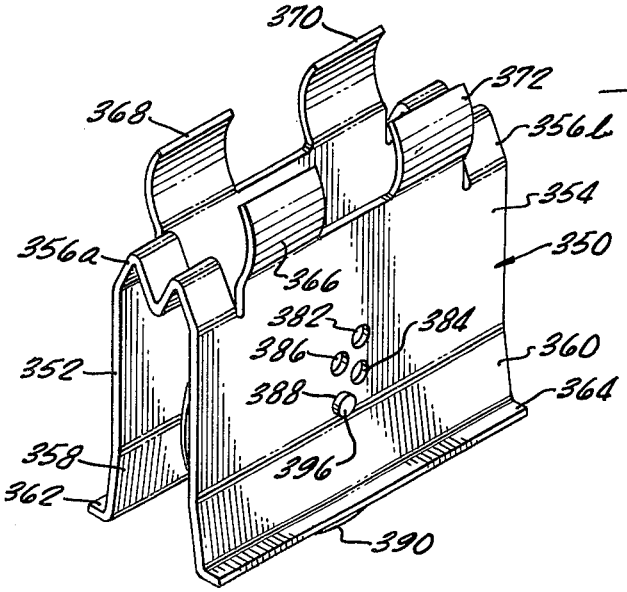
FIGS. 11, 12 and 13 illustrate three different modifications of the bracket.
Figure 12:
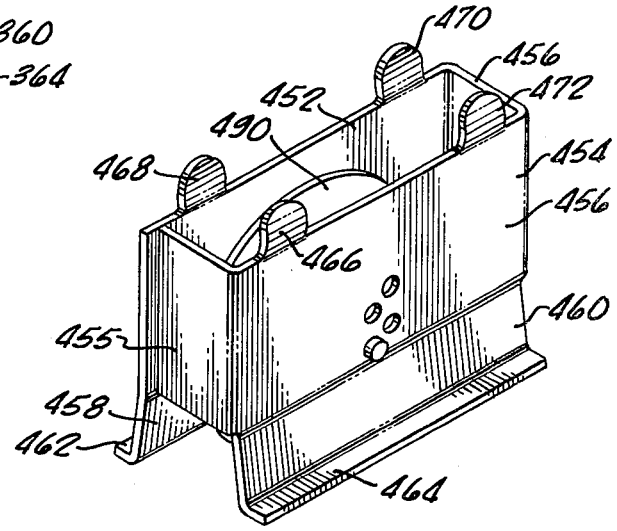
Figure 13:
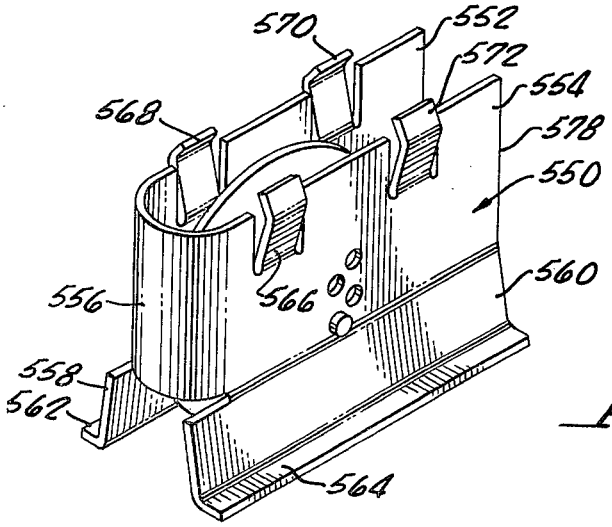

FIGS. 11, 12 and 13 illustrate three of the many different bracket configurations that may be employed.

As shown in FIG. 11, a U-shaped resilient bracket 350 includes sides 352, 354 interconnected at top portions thereof by bight sections **356*a* and 356*b*, which in this case are formed at upper lateral end portions of the bracket sides. Each bight portion includes several bends to enhance its resiliency and flexibility. Resilient spring fingers 366, 368, 370, 372 extend upwardly and are flared outwardly from upper portions of the bracket sides. Although this configuration illustrates two such fingers on each bracket side, it will be readily appreciated that one, three or other numbers of fingers may be employed on each side as deemed necessary or desirable. The lower portions of the bracket sides are flared outwardly as at 358 and 360, just as in the previously described embodiment, and terminate in horizontally directed outwardly projecting channel supporting flanges 362, 364. Each bracket side is formed with a set of wheel journal apertures 382, 384, 386, 388, as previously desribed, for reception of an axle 396 of a wheel 390**.

In the configuration illustrated in FIG. 12, the bracket 450 is U-shaped, having its bight 456 interconnecting lateral end portions of the bracket sides 452, 454. The two sides include outwardly flared lower portions 458, 460 which terminate in horizontally outwardly projecting door supporting flanges 462, 464, just as previously described. In this case one side, such as side 454, includes an integral spacer member 455 projecting from side 454 toward the other side 452. The free end of spacer member 455 is positioned close to but spaced from 452 in the unstresses condition of the bracket of FIG. 12. The spacer member provides a stop that prevents the two bracket sides from being pressed so close together as to bind the wheel 490 which is adjustably supported in the bracket sides in the manner previously described in connection with the other embodiments. In this arrangement, outwardly flared resilient spring fingers 466, 468, 470 and 472 project upwardly and outwardly from upper portions of the bracket sides to enhance the resilient retention of the bracket within and between the side walls of the door frame channel. Although two such fingers are shown on each bracket side, it will be readily appreciated that only one relatively longer finger may be employed on each bracket side or more than two may be employed.

Illustrated in FIG. 13 is still another version of the bracket, similar to the configuration of FIG. 12. U-shaped bracket 550 includes sides 552, 554 interconnected by a round, rather than straight, bight 556 extending between lateral end portions of the sides. In this arrangement no stop member analogous to element 445 of FIG. 12 is employed. The bracket sides flare outwardly at lower portions thereof as indicated at 558, 560 and terminate in horizontally directed outwardly extending door channel support flanges 562, 564. Spring fingers 566, 568, 570 and 572 are cut from the upper portions of the bracket sides and are bent from the planes of the sides to flare outwardly, as previously described. If deemed necessary or desirable, additional spring fingers may be cut from lateral end portions of the bracket sides such as lateral end portions 578 of side 554. Such fingers could be provided in addition to those cut from the upper end portions of the sides.

Each of the bracket configurations shown in FIGS. 11, 12 and 13 may be modified without departing from principles of the present invention and each would preferably include an integral bracket element formed of a single piece of resilient sheet metal or of a molded rigid and resilient plastic. The bracket sides in each case have the described pattern of holes to provide for vertical adjustment of the wheel that carries the bracket just as previously desribed in connection with the embodiments of FIGS. 8–10. Each of these brackets cooperate with the door frame channel to support the latter in the same manner as the bracket of FIGS. 8–10, and all cooperate with the univeral self-closing mechanism kit to enhance its applicability to different types of doors and to improve its operation.

It will be understood that the described anti-friction assembly is readily adapted for use with various types of sliding closures, such as doors and windows, and may employ different types of anti-friction devices such as wheels and glide members. Although a door frame channel is described, it will be appreciated that the bracket assembly disclosed herein can be used with other types of door frame members having a pair of downwardly extending and mutually spaced sidewall elements. The assembly is easily attached to or detached from any one of a number of different door frame configurations without the use of any tools and without any screws, bolts, pins or the like.

There has been described a simple, inexpensive, readily installed and attractive self-closing mechanism and wheel assembly for a sliding door. The several parts of the kit are securely connected merely by adhesive strips and furthermore, provide a pleasant appearance, blending esthetically with the existing door structure. No structural modification of the door or door frame is required, nor is it necessary to employ any tools for the installation. The entire kit, both closing mechanism and wheel assemblies, is constructed and arranged for use with closures of many different types, cooperating with each other to provide a surprising and unexpectedly retrofitting attachment for slide closures.

The foregoing detailed description is to be clearly understood as given by way of illustration and example only, the spirit and scope of this invention being limited solely by the appended claims.

What is claimed is:

1. A gravity actuated door closer assembly for use with a sliding door assembly having a doorway frame including a pair of jambs and a lintel, and a door mounted to slide in the plane of said doorway and having front and rear stiles, said door closer assembly comprising, a vertically extending elongated guide including a contact portion conforming to an outwardly facing surface portion of said rear stile, means for securing said guide to said rear stile with said contact portion of said guide contiguous to said outwardly facing surface portion of said rear stile, a pulley, means for rotatably mounting said pulley to and with said guide, a hook, means for connectinf said hook to said lintel at a point just forward of the closed position of said rear stile, a weight slidable in said guide, and a line entrained over said pulley and connected to and between said hook and weight.

2. The door closer assembly of claim 1 wherein said guide, pulley, hook, weight and line comprise a self-contained unitary package of components adapted to be mounted to an existing sliding door assembly without structural modification of said door or doorway frame.

3. The door closer assembly of claim 2 wherein said means for rotatably mounting said pulley comprises a bracket adapted to be secured to said door, a pin having a head adapted to be captured between said bracket and door and extending through said guide, said pulley being journalled on said pin, whereby said pulley is supported in part by said guide and in part by said door.

4. The door closer assembly of claim 2 wherein said guide contact portion includes substantially planar contact surfaces spaced along said guide, wherein said outwardly facing surface portion of said rear stile includes planar contact surfaces, and wherein said means for securing said guide to said door comprises means adhesively connected to an interposed between said guide contact surfaces and said rear stile contact surface.

5. The door closer assembly of claim 4 wherein said means for rotatably mounting said pulley comprises a pin fixedly mounted to said guide, said pulley being journalled on said pin.

6. The door closer assembly of claim 4 wherein said means for rotatably mounting said pulley comprises a pulley mounting plate adhesively secured to said rear stile contact surface, a pin extending through said plate and through said guide and having a head captured between said plate and said door, said pulley being journalled on said pin.

7. The door closer assembly of claim 6 wherein said guide comprises a member of C shaped cross-section having a pair of mutually facing and mutually spaced coplanar flanges defining said planar contact surfaces of said guide, said pulley mounting plate being interposed between said flanges and being coplanar therewith.

8. The door closer assembly of claim 4 including a magnet, means for mounting the magnet on a jamb of said doorway, and magnetic means on said guide cooperating with said magnet to magnetically latch said door in open position.

9. The door closer assembly of claim 8 wherein said guide comprises first and second non-ferrous guide sections in end to end relation and wherein said magnetic means comprises a strip of ferrous material secured to said guide and bridging adjacent ends of said guide sections.

10. A gravity actuated sliding door closer assembly, comprising, a doorway frame including a pair of jambs and a lintel, a door mounted to slide in the plane of said doorway frame, and a unitary self-contained door closing kit adapted to be mounted to said door and frame without structural modification thereof, said kit comprising, an elongated guide member adapted to extend vertically along a rear portion of said door, said guide including contact surface means conforming to an outwardly facing surface portion of the rear of said door, adhesive means for securing said guide to said door with said contact portions of said guide contiguous to said outwardly facing surface portions of said door, a substantially U shaped pulley bracket adapted to be adhesively secured to said door within said guide, a pin extending through said pulley adapted to be interposed between said pulley and said door and having an enlarged head, said pin extending through said guide and having one end supported thereby, a hook adapted to be secured to said door frame lintel at a point just forward of said portion of said door in closed position, an elongated weight within said guide, a line entrained over said pulley and adapted to be secured at opposite ends thereof to said hook and to said weight.

11. The apparatus of claim 10 wherein said elongated guide comprises a member having a "C" shaped cross-section with first and second mutually spaced and coplanar inner flanges, said inner flanges defining said guide contact portions and conforming to outwardly facing surface portions of said door.

12. The apparatus of claim 10 wherein said kit includes an anti-friction assembly constructed and arranged to be mounted to said door without use of tools, said anti-friction assembly comprising a bracket having mutually spaced sides extending in side-by-side relation, means for resiliently connecting said sides to each other, an outwardly projecting flange on bottom portions of each of said sides, and an anti-friction member positioned in said sides.

13. The apparatus of claim 12 wherein said means for interconnecting said sides includes means for urging bottom portions of said sides outwardly away from one another whereby said bracket may be received in a downwardly opening channel of said door with portions of said sides spaced inwardly of said channel, with said bottom portions pressed against said channel, and with said flanges projecting outwardly of lower edges of said channel.

14. The apparatus of claim 13 wherein said bracket is formed of a resilient material, is of a substantially U-shaped cross-section having a bight interconnecting said sides, and is outwardly flared.

15. The method of mounting a gravity actuated door closer assembly upon a previously installed and operating sliding door assembly without structural modification of said assembly, said door assembly comprising a doorway having at least a lintel and a jamb, and a door having forward and rear stiles slidably mounted for motion in the plane of said doorway, said method comprising the steps of, mounting a pulley upon a journal pin, securing the pulley and journal pin to the upper portion of an outwardly facing surface of said rear stile, securing a hook on said doorway lintel just forward of the closed position of said rear stile, entraining a line over said pulley and securing said line to said hook, attaching a weight to said line and adjusting the length of said line to cause said weight to clear the bottom of said door when said door is in closed position, and securing an elongated guide channel to said outwardly facing surface of said rear stile so as to extend along the length of said rear stile with said line and weight hanging freely within said channel and with said journal pin supported by an upper portion of said channel.

16. The method of claim 15 including the steps of testing the operation of said door and adjusting the length of said line, securing to said outwardly facing door surface a second guide member in end to end relation with said first named guide member with said weight hanging within said second guide member when said door is in closed position, attaching a ferrous strip to said guide members at the adjacent ends thereof and attaching a magnet to a jamb of said doorway.

17. The method of claim 16 wherein at least some of said attaching steps comprise adhesively securing to said door an adhesive strip having adhesive on both sides thereof.

18. The method of mounting a gravity actuated door closer assembly upon a previously installed and operating sliding door assembly, said door assembly comprising a doorway having at least a lintel and a jamb, and a door having forward and rear stiles slidably mounted for motion in the plane of said doorway, said method comprising the steps of, mounting a pulley upon a journal pin, fixing said pin to the upper end of an elongated guide channel, securing said guide channel to an outwardly facing surface of said rear stile so as to extend along the length of said rear stile, securing a hook on said doorway lintel at a point just forward of the closed position of said rear stile, entraining a line over said pulley and securing said line to said hook, inserting said line through said guide channel, attaching a weight to the line, and adjusting the length of the line to cause the weight to clear the bottom of the door when the door is in closed position.

19. An anti-friction assembly for use with a sliding closure comprising a bracket having mutually spaced resilient sides extending in side-by-side relation and diverging downwardly and outwardly from upper portions thereof, means for resiliently connecting said sides to each other, said means including means for urging bottom portions of said sides outwardly away from one another for the full length of said sides whereby said bracket may be received in a downwardly opening channel of a closure member with portions of said sides spaced inwardly of said channel, with said bottom portions pressed outwardly against said channel for the full length of the sides, and with said flanges projecting outwardly of lower edges of said channel, said flanges comprising the entire closure support portions of said bracket, whereby all of the support pressure of said closure upon said bracket is exerted upon said flanges.

20. The assembly of claim 19 wherein said anti-friction member includes a wheel having an axle, and within each side of said bracket is formed with a plurality of holes mutually displaced both vertically and horizontally, said axle being selectively journalled in corresponding holes or respective sides of the bracket for selective vertical positioning of said wheel.

21. The assembly of claim 19 wherein said sides are resiliently flared outwardly at both top and bottom.

22. A sliding door assembly comprising a sliding door frame including a bottom frame member having first and second mutually spaced sidewall elements with downwardly facing sidewall edges, said elements being interconnected by a web, a bracket mounted in said frame member between said sidewall elements, said bracket comprising first and second bracket sides extending in side-by-side and mutually spaced relationship and respectively in contact with said sidewall elements, said bracket sides diverging downwardly and outwardly for the full length of said bracket, and being resiliently pressed against said sidewall elements, each said bracket side including frame support means engaging said sidewall edges of said frame member for supporting the full weight of said frame upon said bracket, said support means comprising an outwardly extending flange on the lower end of each bracket side, said flanges being resiliently pressed outwardly with said bracket sidewalls to insure engagement of the flanges with said downwardly facing sidewall edges of said door frame, a bight interconnecting upper ends of said bracket sides and spaced from said web, an anti-friction member, and means for mounting said anti-friction member in said bracket between said bracket sides.

23. The assembly of claim 22 wherein said anti-friction member comprises a wheel, said means for mounting comprising a wheel axle on said wheel and a plurality of holes in said bracket sides, the holes in one bracket side being mutually spaced vertically and horizontally from each other, the holes in the other bracket side being similarly spaced from each other, said axle having opposite ends thereof respectively received in a hole in one of said bracket sides and a corresponding hole in the other of said bracket sides.

24. A wheel and bracket assembly for sliding doors comprising a bracket of substantially U-shaped cross-section formed of resilient material, said bracket having first and second mutually spaced sides extending in side-by-side relation and diverging outwardly from top to bottom of said bracket for the full length thereof, and a bight resiliently interconnecting said sides, each side being formed with an outwardly projecting door support flange at the bracket bottom, said flanges being urged outwardly by said bracket sides, a wheel, and means for supporting said wheel upon and between said bracket sides.

25. The assembly of claim 24 wherein said bracket sides include portions that are flared outwardly to further resiliently press against the walls of the door member in which the assembly is inserted to thereby retain the assembly within said door member.

26. The assembly of claim 24 wherein said means for supporting said wheel comprises means for mounting said wheel in any one of a plurality of different positions of adjustment relative to said bracket.

27. The assembly of claim 24 wherein said bracket includes a plurality of resilient outwardly projecting fingers.

28. The assembly of claim 27 wherein said outwardly projecting fingers are defined by mutually spaced transverse slots formed in said bracket and extending through said bight and downwardly into said first and second bracket sides respectively, and at least one longitudinal slot extending through said bight from respective ones of said transverse slots.

29. The assembly of claim 24 wherein portions of each of said sides incline downwardly and outwardly from said bight.

30. The assembly of claim 24 wherein said sides diverge outwardly and include a plurality of resilient outwardly projecting fingers.

31. The assembly of claim 30 wherein said bight interconnects upper portions of said sides.

32. The assembly of claim 30 wherein said bight interconnects lateral end portions of said sides.

33. The assembly of claim 30 including means connected to one of said sides and extending toward the other to limit motion of said sides toward each other.

* * * * *